US006878004B2

(12) United States Patent
Oh

(10) Patent No.: US 6,878,004 B2
(45) Date of Patent: Apr. 12, 2005

(54) MULTI-ELEMENT FUSE ARRAY

(75) Inventor: Seibang Oh, Elk Grove Village, IL (US)

(73) Assignee: Littelfuse, Inc., Des Plaines, IL (US)

( * ) Notice: Subject to any disclaimer, the term of this patent is extended or adjusted under 35 U.S.C. 154(b) by 0 days.

(21) Appl. No.: 10/090,896

(22) Filed: Mar. 4, 2002

(65) Prior Publication Data

US 2003/0166352 A1 Sep. 4, 2003

(51) Int. Cl.[7] ..... H01R 13/64
(52) U.S. Cl. ..... 439/250; 439/76.2; 439/849
(58) Field of Search ..... 439/76.2, 250, 439/849, 949

(56) References Cited

U.S. PATENT DOCUMENTS

| | | | | |
|---|---|---|---|---|
| 480,802 | A | 8/1892 | Blathy | 337/278 |
| 1,700,582 | A | 1/1929 | Brown | |
| 2,245,346 | A | 6/1941 | Klein | |
| 2,794,346 | A | 6/1957 | Jacobs, Jr. | |
| 3,619,725 | A | 11/1971 | Mendham et al. | 148/DIG. 2 |
| 3,775,723 | A | 11/1973 | Mamrock et al. | 337/187 |
| 3,909,767 | A | 9/1975 | Williamson et al. | 337/198 |
| 3,913,219 | A | 10/1975 | Lichtblau | |
| 4,023,265 | A | 5/1977 | Aryamane | 29/623 |

(Continued)

FOREIGN PATENT DOCUMENTS

| | | | | |
|---|---|---|---|---|
| DE | 2714797 | A1 | 2/1979 | |
| DE | 3530354 | | 3/1987 | |
| EP | 0270954 | A1 | 6/1988 | |
| EP | 0301533 | A2 | 7/1988 | |
| EP | 0285489 | A1 | 10/1988 | |
| EP | 0453217 | A1 | 10/1991 | |
| EP | 0581428 | A1 | 2/1994 | |
| EP | 0802553 | A2 | 10/1997 | |
| EP | 0939417 | A1 | 9/1999 | |
| EP | 1109190 | A1 | 6/2001 | |
| EP | 1 109 190 | * | 6/2001 | |
| FR | 2 805 662 | * | 8/2001 | H01H/85/20 |
| GB | 1604820 | | 12/1981 | |
| GB | 2089148 | | 6/1982 | |
| GB | 2113489 | A | 8/1983 | |
| GB | 2133489 | A | 8/1983 | |
| GB | 2233512 | A | 1/1991 | |
| JP | 60180382 | | 8/1985 | |
| JP | 4033230 | | 2/1992 | |
| JP | 04242036 | | 8/1992 | |
| JP | 4245129 | | 9/1992 | |
| JP | 4245132 | | 9/1992 | |
| JP | 4248221 | | 9/1992 | |
| JP | 4255627 | | 9/1992 | |
| JP | 51666454 | | 7/1993 | |
| JP | 05314888 | | 11/1993 | |
| JP | 10241546 | A | 9/1998 | |
| NL | 1803554 | | 5/1969 | |
| NL | 3728489 | A1 | 6/1982 | |
| WO | WO90/00305 | | 1/1990 | |
| WO | WO91/14279 | | 9/1991 | |

*Primary Examiner*—Michael C. Zarroli
(74) *Attorney, Agent, or Firm*—Bell, Boyd & Lloyd LLC

(57) ABSTRACT

The present invention provides a fuse block having a plurality of fuse connections. The fuse connections include an array of embedded terminals that contact the initially provided fuse elements. When one of the fuse elements opens, an operator remakes the open connection by inserting an external replacement fuse. The fuse connections therefore eliminate the need to initially provide separate external fuses. In an embodiment, the terminals include fork shaped projections that receive one of the terminals of the replacement fuse, which also eliminates the need for additional female inserts commonly found in automobile fuse blocks. The fuse block is simple, wherein a plurality of same may be provided in an automobile to cut down on long lengths of wire running from load devices to a traditional, single centrally located fuse block.

26 Claims, 13 Drawing Sheets

U.S. PATENT DOCUMENTS 4,071,837 A 1/1978 Ranzanigo ..... 337/268
4,099,320 A 7/1978 Schmidt, Jr. et al. ..... 29/623
4,131,869 A 12/1978 Schmidt, Jr. et al. ..... 337/264
4,164,725 A 8/1979 Wiebe ..... 337/198
4,198,744 A 4/1980 Nicolay
4,224,592 A 9/1980 Urani et al. ..... 337/198
4,278,706 A 7/1981 Barry ..... 427/96
4,503,415 A 3/1985 Rooney ..... 337/160
4,504,816 A 3/1985 Viola et al.
4,514,718 A 4/1985 Birx
4,533,896 A 8/1985 Beloposky
4,540,969 A 9/1985 Sugar
4,544,907 A 10/1985 Takano ..... 337/262
4,547,830 A 10/1985 Yamauchi ..... 361/104
4,554,732 A 11/1985 Sadlo et al.
4,570,147 A 2/1986 Ebi ..... 29/620
4,580,124 A 4/1986 Borzoni
4,604,602 A 8/1986 Borzoni
4,608,548 A 8/1986 Borzoni
4,612,529 A 9/1986 Gurevich et al.
4,626,818 A 12/1986 Hilgers
4,635,023 A 1/1987 Oh
4,646,053 A 2/1987 Mosesian ..... 337/232
4,652,848 A 3/1987 Hundrieser ..... 337/297
4,661,793 A 4/1987 Borzoni ..... 337/260
4,672,352 A 6/1987 Takano
4,703,299 A 10/1987 Vermij
4,726,991 A 2/1988 Hyatt et al.
4,771,260 A 9/1988 Gurevich ..... 337/231
4,792,781 A 12/1988 Takahashi et al.
4,837,520 A 6/1989 Golke et al.
4,869,972 A 9/1989 Hatagishi
4,871,990 A 10/1989 Ikeda et al.
4,873,506 A 10/1989 Gurevich ..... 337/290
4,894,633 A 1/1990 Holtfreter
4,975,551 A 12/1990 Syvertson
4,997,393 A 3/1991 Armando ..... 439/620
4,998,086 A 3/1991 Kourinsky et al.
5,023,752 A * 6/1991 Detter et al. ..... 361/752
5,084,691 A 1/1992 Lester et al.
5,095,297 A 3/1992 Perreault et al.
5,097,246 A 3/1992 Cook
5,097,247 A 3/1992 Doerrwaechter
5,101,187 A 3/1992 Yuza
5,102,506 A 4/1992 Tanielian
5,102,712 A 4/1992 Peirce et al.
5,115,220 A 5/1992 Suuronen et al.
5,130,688 A 7/1992 Van Rietschoten et al.
5,139,443 A 8/1992 Armando
5,140,295 A 8/1992 Vermot-gaud et al. ..... 337/297
5,148,141 A 9/1992 Suuronen
5,155,462 A 10/1992 Morrill
5,166,656 A 11/1992 Badihi et al.
5,207,587 A * 5/1993 Hamill et al. ..... 439/76.2
5,340,775 A 8/1994 Carruthers
5,363,082 A 11/1994 Gurevich
5,374,590 A 12/1994 Batdorf
5,569,880 A * 10/1996 Galvagni et al. ..... 174/52.4
5,581,225 A 12/1996 Oh et al.
5,631,620 A 5/1997 Totsuka et al.
5,663,861 A 9/1997 Reddy et al.
5,668,521 A 9/1997 Oh
5,715,135 A * 2/1998 Brussalis et al. ..... 361/624
5,831,814 A * 11/1998 Hamill ..... 361/627
5,884,477 A 3/1999 Andou et al.
6,077,102 A * 6/2000 Borzi et al. ..... 439/364
6,280,253 B1 * 8/2001 Kraus et al. ..... 439/621
6,322,376 B1 * 11/2001 Jetton ..... 439/76.2
6,494,723 B2 * 12/2002 Yamane et al. ..... 439/76.2
6,496,096 B2 12/2002 Kondo et al. ..... 337/234
6,515,226 B2 * 2/2003 Chiriku et al. ..... 174/50
6,541,700 B2 * 4/2003 Chiriku et al. ..... 174/50

* cited by examiner

MULTI-ELEMENT FUSE ARRAY

BACKGROUND OF THE INVENTION

The present invention relates to the field of electrical protection. More particularly, the present invention relates to fuse connections.

Current fuse blocks and junction boxes for automobiles are complicated. Referring to FIG. 1, a prior art junction box 10 is illustrated. The prior art junction box includes a number of primary components, such as the prior art fuse block 12, a cover 14 and a lower housing 16. The prior art fuse block 12 includes an upper press-fit layer 18 that mates with a lower press-fit layer 20. The upper and lower press-fit layers 18 and 20 mate with an upper housing 22. The upper housing 22 mates with the upper press-fit layer 18 and the lower press-fit layer 20, which collectively mate with the lower housing 16. The cover 14 mates with the upper housing 22.

Prior art fuse block 12 includes a number of electrical devices 24. For example, the electrical devices 24 can include JCASE® fuses and MINI® fuses provided by the assignee of this invention, mini and micro relays, and solid state relays. The fuses can be blade fuses.

The fuses 26 individually insert into a pair of female inserts 28, which are illustrated as being connected to the upper press-fit layer 18. The upper housing 22 defines apertures, wherein the female inserts 28 extend through the apertures so that an operator may place a fuse 26, either initially or after an open fuse condition, into the pair of female inserts 28. The female inserts 28 connect to the upper press-fit layer 18 by press-fitting over a terminal 30, which itself mechanically or press-fits into the upper press-fit layer 18.

Referring to FIG. 2, a prior art terminal 30 is illustrated in phantom line. The prior art terminal 30 includes a projection 32 that extends from the upper press-fit layer 18, through the lower press-fit layer 20 and through the lower housing 16. The prior art terminal 30 also includes a projection 34 that extends a lesser distance in the same direction as the projection 32. The lower press-fit layer defines apertures that slide over and around the projections 32 and 34.

The prior art terminal 30 also fits into the upper press-fit layer 18. An upwardly extending projection 38 fits through apertures defined by the upper press-fit layer 18. Similar to the downwardly extending projections 32 and 34, the upward projection 38 extends further than a second projection 36. The projection 38 extends upwardly and outwardly from the upper press-fit layer 18 and engages the female insert 28.

It should therefore be appreciated that the prior art fuse block 12 of the prior art junction box 10 includes a multitude of components that must press-fit together. The prior art requires separate female inserts 28, which are unwanted due to cost, complexity and weight. Further, because the assembly of the prior art fuse block 12 of the prior art junction box 10 is relatively complicated, automobile manufacturers have tended to provide only one junction box 10 per vehicle. This creates a condition wherein the load wires that run from the various electrical devices have to run all the way to the single junction box 10 regardless of the position of the load device in the vehicle. Extended lengths of load wires create weight, cost and the potential for short circuits.

A need therefore exists to provide a simplified automobile fuse block and junction box employing same.

SUMMARY OF THE INVENTION

In one aspect, the present provides a fuse block. The fuse block includes a plurality of fuse connections. The fuse connections initially eliminate the need to provide separate external fuses. When one of the fuse connections opens, an operator remakes the open connection by inserting an external replacement fuse. In one embodiment, the fuse elements are separate from the fuse body. In such a case, the fuse elements can be any type of material and shape used for conventional fuses. In one embodiment, the fuse element is spiral wound, which provides a time delay characteristic to the operation of the fuse block.

In another embodiment, the fuse elements are of a "thin-film" type or surface mounted. Here, the fuse elements can be surface mounted onto a separate substrate that defines apertures or slots, which enable the substrate and surface mount fuses to slide over and electrically connect to the terminals. The surface mount element can be provided having a multitude of separate parallel strands, which provide a higher current carrying characteristic to the operation of the fuse block.

The fuse block includes a body. The body is made of an insulative material, such as plastic. The body in an embodiment is one piece but in alternative embodiments has a plurality of pieces that fit, for example, snap-fit or bolt together. Multiple terminals fix to the body. In an embodiment, multiple terminals are molded into a plastic body. The terminals can have one or more apertures that allow the plastic in a liquid state to flow through the apertures to provide a sturdy mount.

The body of the fuse block connects to a number of other pieces. For example, a module is provided to which a multitude of wires connect. One use for the fuse block of the present invention is in automobiles. The wires that connect to the modules can therefore be automobile wires that extend to any type of electrical component found in an automobile. The wires can also run to other modules of other fuse blocks.

The module snap-fits and/or bolts to the body of the fuse block. The module makes electrical contact between the multitude of wires and a like number of terminals imbedded within the body. The terminals therefore, in an embodiment, extend from two opposing sides of the body. The terminals extend from one side and electrically mate with the fuse elements. The terminals extend from the opposing side of the body and electrically couple to the wires of the plug in module.

The fuse elements electrically connect to at least two of the terminals to create at least one fuse connection. The fuse block includes many fuse connections and therefore many pairs of fuse-linked terminals. The fuse block includes sets or rows of terminals, wherein terminals from adjacent sets or rows are connected by fuse elements. In an embodiment, the terminals of one of the rows electrically connect to a power line, for example, the common power line. In this manner, one set or row of terminals electrically connects to the common supply line, while the fuse linked set or row electrically connects to various different loads within, for example, an automobile.

In an embodiment, the side of the terminal extending from the body of the fuse block that electrically connects to the fuse element also provides for the receipt of a terminal from an external replacement fuse. That is, when the initially provided fuse element opens, the operator corrects the fault by inserting a standard fuse, for example, a standard automotive fuse.

The body of the fuse block also connects to a number of protective parts. A protective member mounts a distance away from the body, between the fuse element mounting portion of the terminals and the replacement fuse insertion portion of the terminals. The protective member defines a plurality of apertures that fit over and around the terminals and over and around a plurality of mounts that project from the body. The member fixes to the mounts, for example, through a staking process. The protective member covers the fuse elements and enables a person to safely mount replacement fuses to the second portions of the terminals. In an embodiment, the protective member is translucent or transparent so that an operator can see which fuse element has opened.

The body of the fuse block also mates with and attaches to a protective cover. The protective cover, unlike the protective member, fits completely over the terminals.

The fuse block can be arranged electrically in a plurality of different ways. First, the terminals inside the body of the fuse block can include the fuse elements but not include the power connections or "bussing" as it is commonly called. When the terminals molded into the body do provide the bussing, it can be done in a plurality of ways. In one example, the body includes a plurality of sets or rows of terminals, wherein adjacent terminals of the sets or rows are connected together by a fuse element. Here, one of the rows can be bussed or electrically connected to a power supply line, such as the common line. With this embodiment, each different pair of rows of fuses can have a differently rated fuse element.

In another embodiment, sets of three terminals of three adjacent sets or rows of terminals are connected together with at least one fuse element. The bussing occurs by electrically connecting the terminals of one of the rows to a power supply line. In an embodiment, the terminals of the central row are bussed together to provide power to the terminals, through one or more fuse elements, in the two outer rows. If the fuse opens between the middle fuse and one of the outer fuses, a fuse link still exists between the middle fuse and the other adjacent terminal.

The bussing in one embodiment is provided by inserting or molding a strip of physically and electrically connected terminals into the fuse body instead of separate terminals. One way to manufacture the terminals is to make such a strip of the terminals and then separate them into individual terminals. For the bussed rows, however, the strip is left in tact and is sized so that the terminals are spaced properly apart.

In another aspect of the present invention, a terminal for a fuse block is provided. The terminal includes a first portion that extends from a side of the fuse block and contacts a fuse element. A second portion of the terminal extends from the same side of the fuse block as the first portion. The second portion receives a terminal of a separately mounted replacement fuse.

The terminal in an embodiment is of a "tuning fork" variety, wherein a plurality of projections extend from the fuse block. This type of terminal creates a notch or groove that accepts the terminal of a male replacement fuse, such as a blade fuse, for example a MINI®fuse. A first portion of the terminal contacts the fuse element. When the fuse element is a separate fuse element, such as a spiral wound fuse element, the first portion includes a first groove defined by a middle projection and an outer projection. When the fuse element is of a surface mount variety, the first portion of the terminal includes the middle section of the fuse element that electrically contacts the surface mount element.

A second portion of the terminal, which receives the terminal of the separately mounted replacement fuse includes a second groove or slot defined by the middle projection and a second outer projection. The second portion, which receives the terminal of a separately mounted replacement fuse, extends further from the fuse block than does the first portion. This enables the fuse element, which contacts the first portion, to remain closer to the fuse block than the replacement fuse. In this manner, a protective member can be placed over the fuse elements but beneath the second portion, which needs to be accessible by an operator to place a replacement fuse therein.

In another embodiment, the terminal includes a male projection. The male projection receives a female type fuse, such as the JCASE® fuse. Here, when the fuse element is a separate type, for example, a spiral wound fuse element, the first portion that contacts the fuse element again includes the first groove defined by the male projection and an outer projection. When the fuse element is of a surface mount variety, no outer projection is required. The second portion of the male projection terminal, which receives the female terminal of the separately mounted female replacement fuse does not define a separate groove via an outer projection but simply includes the male projection.

Besides the first and second portions of the terminal, the above described terminals also include another area or portion that contacts an electrical lead. The electrical lead can be a buss wire or a wire to a load device. For the bussing, the additional area or portion in one embodiment, as described above, is the connecting area along the strip of fuses. For the load wires, the additional portion of the terminal in an embodiment includes a projection extending from the opposing side of the fuse block than the side from which the first and second portions extend. Here, the additional portion or projection electrically communicates with a wire or electrical lead that terminates inside a plug-in module. The module snap-fits or bolts to the opposing side of the fuse block.

In a further aspect of the present invention, a method of providing fuse protection is provided. The method includes providing a body and fixing a plurality of terminals to the body, so that the terminals are exposed on at least one side of the body. The method also includes contacting at least two of the plurality of terminals with a fuse element. Further, a location on the plurality of terminals is provided for receiving a terminal of a replacement fuse when the fuse element opens. The terminal of the replacement fuse can be a male or female terminal.

The terminals are placed in sets or rows, so that the fuse element contacts one of the terminals from one of the sets or rows and another of the terminals from an adjoining set or row. The first and second rows are spaced apart and arranged so that the terminals of the rows can receive the male or female replacement fuse.

The method includes contacting a plurality of adjacent terminals from the rows with a plurality of unique fuse elements, so as to create a plurality of electrical connections. The method includes positioning and arranging the sets or rows of terminals so that a plurality of replacement fuses can be received by a unique terminal from each set or row.

The method includes electrically connecting at least two and possibly all the terminals of a particular set or row of terminals to a power supply line and in particular a common line. In an alternative embodiment, the method includes arranging three rows or sets of fuses, wherein one or more fuse elements contacts three terminals from each row. The three terminals produce two separate electrical connections, whereas the earlier embodiment needed four terminals to make two electrical connections. The terminals of the middle set or row in an embodiment electrically connect to a common power line.

In still another aspect of the present invention, a method for providing fuse connections in an automobile is provided. The method includes locating a plurality of junction boxes having fuse-linked terminals proximate to localized loads within the automobile. The method includes electrically connecting one of the terminals from the fuse-linked terminals to the localized loads. Further, the method includes bringing power to another one of the terminals from the fuse-linked terminals.

It should be appreciated that while the multi-element array of the present invention is particularly suited for automobiles, the present invention is expressly not limited to such use. For example, the multi-element array of the present invention is suitable for any type of two, three, four or multi-wheeled vehicle employing a multitude of fuses. Moreover, the multi-element array of the present invention can be used in any device employing a multitude of fuses.

It is therefore an advantage of the present invention to provide an automobile fuse array of a size and arrangement such that a plurality of same may be located at strategic points within an automobile, so as to reduce the amount and weight of wire needed to harness the automobile.

Another advantage of the present invention is to provide a simplified fuse block.

A further advantage of the present invention is to provide a simplified junction box.

Yet another advantage of the present invention is to provide a fuse block and junction box therefore, which is readily assembled.

Yet a further advantage of the present invention is to provide a fuse block, which reduces the number of components needed.

Additional features and advantages of the present invention are described in, and will be apparent from, the following Detailed Description of the Invention and the figures.

DETAILED DESCRIPTION OF THE INVENTION

Figure 2:
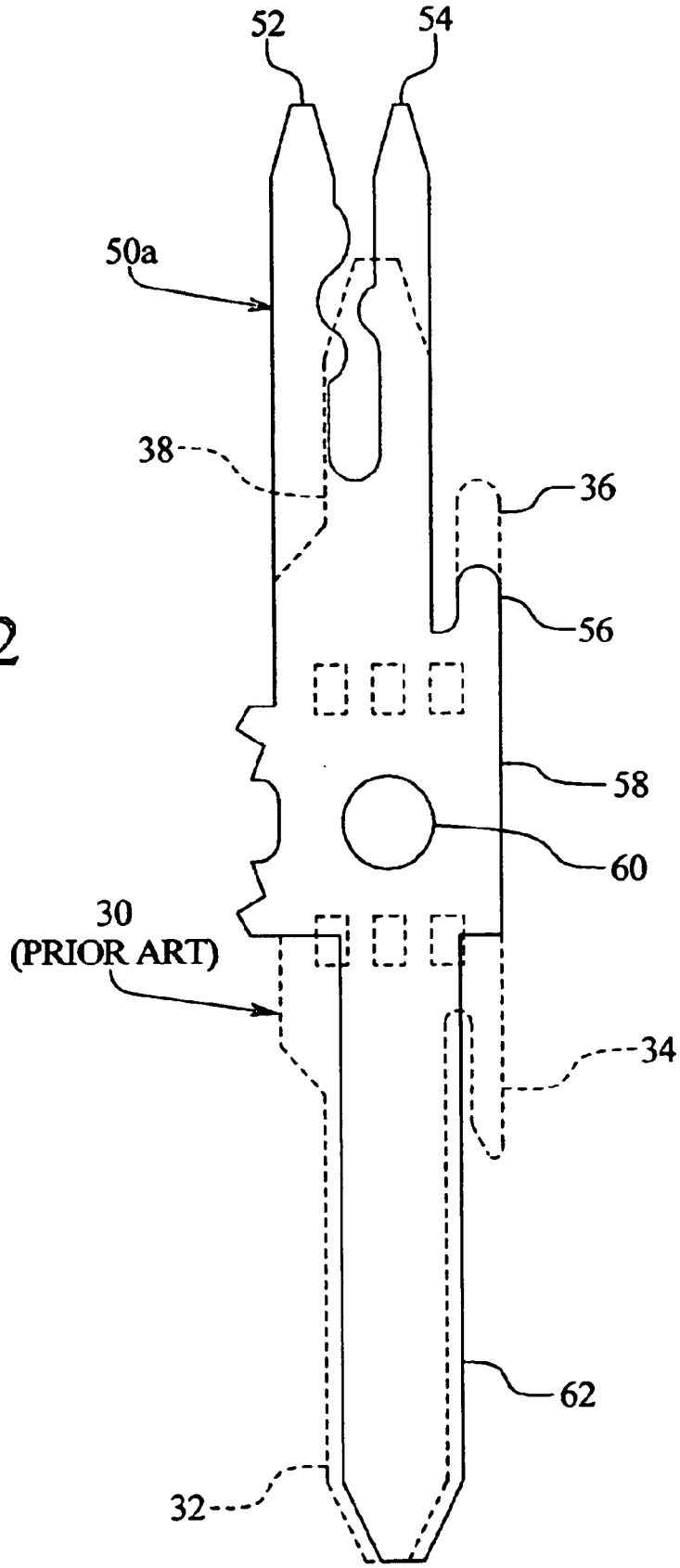
FIGS. 2 to 5 are elevation views of a prior art terminal superimposed with a multitude of embodiments of the terminal of the present invention.

Referring now to the drawings and in particular to FIGS. 2 to 5, various terminals of the present invention are illustrated. FIG. 2 illustrates the terminal 50*a* superimposed in solid onto the prior art terminal 30, which is illustrated in phantom. With respect to the prior art terminal 30, the terminal 50*a* of the present invention includes forked projections 52 and 54 that extend upwardly as opposed a single upwardly extending projection 38 of the prior art terminal 30. As will be illustrated below, the forked projections 52 and 54 are positioned and arranged to receive a terminal of an externally mounted replacement fuse. The forked projections 52 and 54 are extended further upwardly with respect to the projection 38 of the prior art terminal 30.

The prior art terminal 30 also includes the upwardly extending projection 36, which is used for wiring. As may be seen from FIG. 2, the projection 36 has been lowered to produce the upwardly extending projection 56 of the terminal 50*a* of the present invention. As will be illustrated below, the projection 56 cooperates with the forked projections 52 and 54 to hold a fixedly attached, e.g., soldered, fuse element.

A middle portion 58 of the terminal 50*a* defines a hole or aperture 60, which aids the terminal 50*a* in being mounted to the fuse block body as illustrated more fully below. The aperture 60 in an embodiment enables liquidous plastic in a plastic molding operation to penetrate through the terminal 50*a* to more securely attach same. With respect to the prior art terminal 30, the downwardly extending projection 34 has been eliminated. Also, the projection 62 that extends downwardly from the middle portion 58 has been narrowed in certain places.

Figure 3:
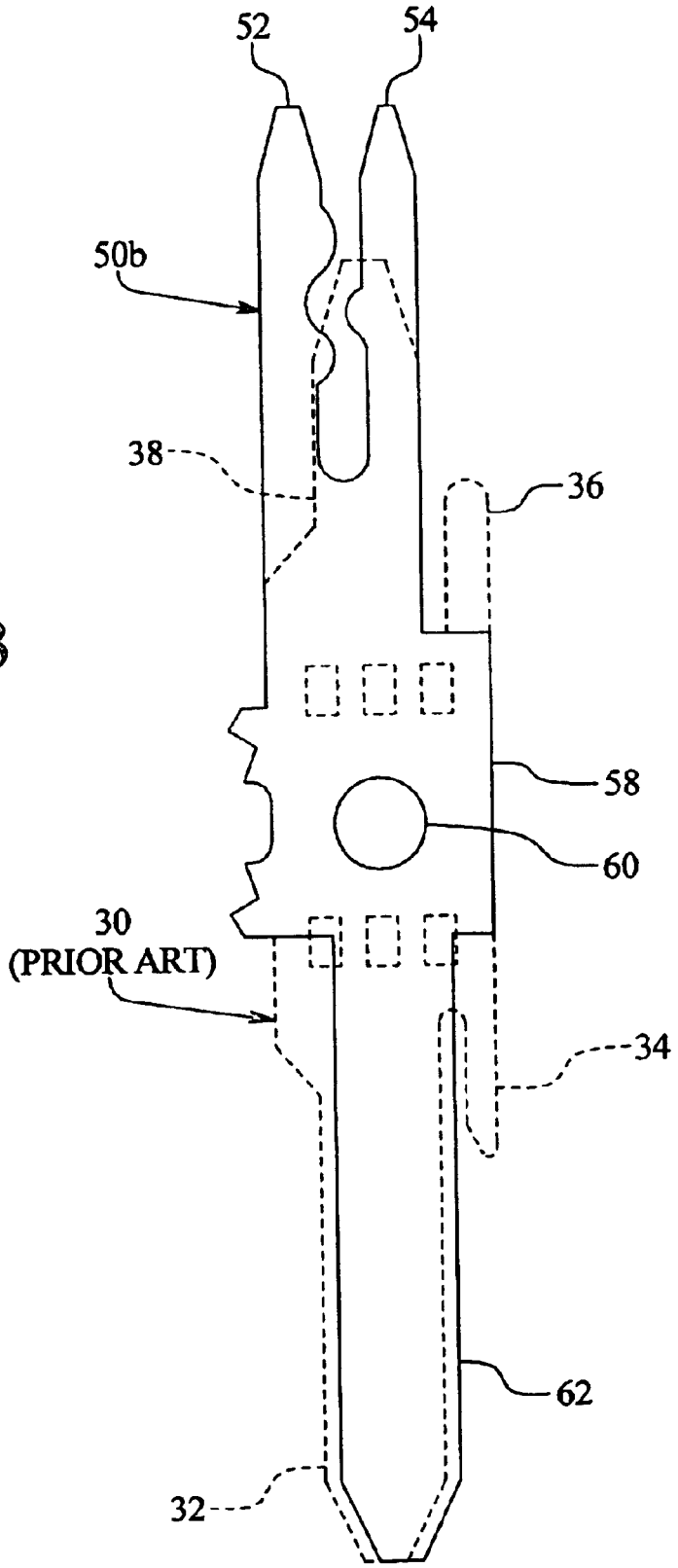

The terminal 50*a* of FIG. 2 is used with a male type replacement fuse, such as a blade fuse, for example, a MINI® fuse. The terminal 50*a* of FIG. 2 is also used when a separate fuse element, such as a spiral wound fuse element is employed. Referring now to FIG. 3, the terminal 50*b* is also used with a male type replacement fuse and therefore includes the forked projections 52 and 54. The terminal 50*b*, however, is used with a surface mount fuse element, which removes the need for a separate groove or notch. Accordingly, terminal 50*b* does not provide or include the projection 56.

One embodiment of the present invention includes using the bussing arrangements currently employed in automobile fuse blocks with the other features and advantages described herein. In such as case, any of the embodiments for the terminals 50*a* to 50*d* discussed herein may alternatively include the projection 34, which is currently used for bussing.

Figure 4:
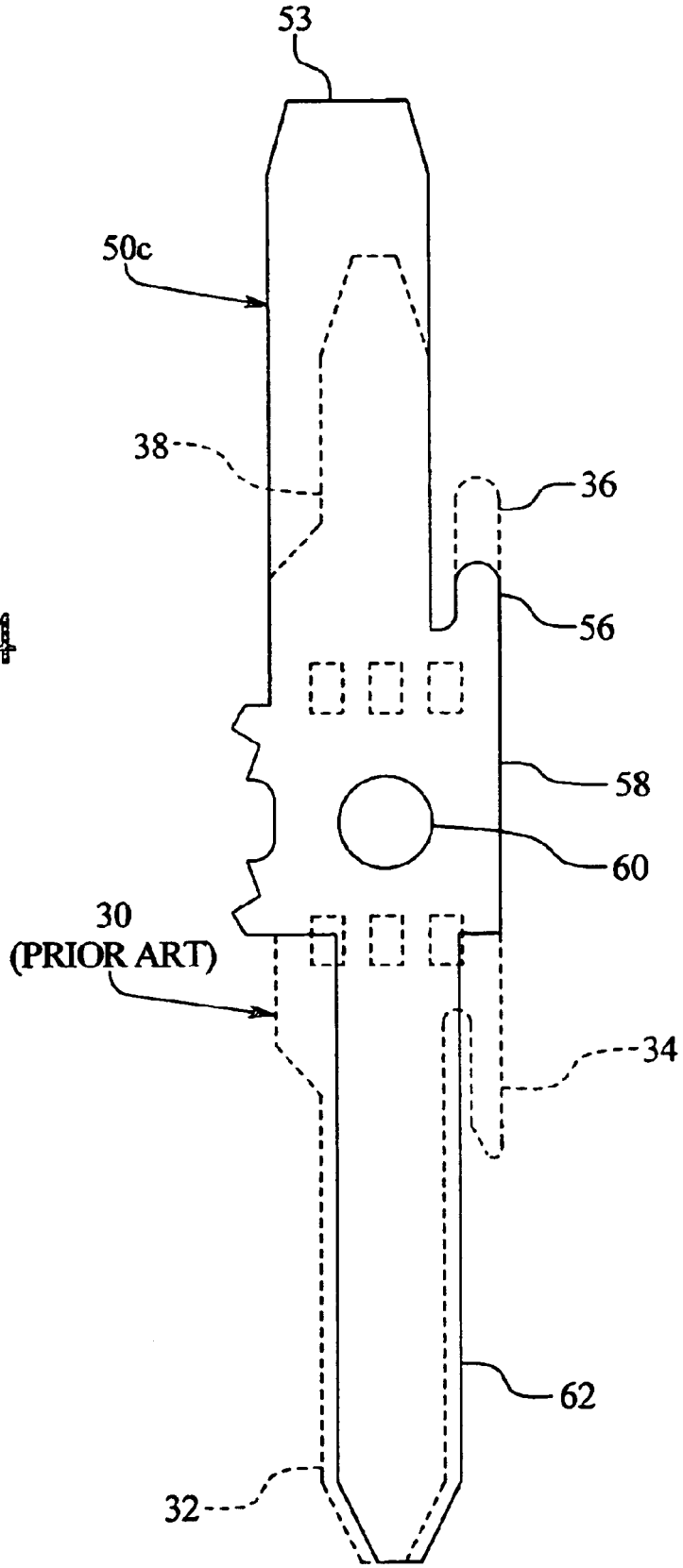

Referring now to FIG. 4, the terminal 50*c* is used with a female type replacement fuse, such as a JCASE® fuse. Accordingly, the terminal 50*c* includes only a single projection 53, which receives the female terminal of the female fuse. The terminal 50*c* of FIG. 2 is also used when a separate fuse element, such as a spiral wound fuse element is employed. Accordingly, the terminal 50*c* includes the extra projection 56, to which the separate fuse element electrically connects.

Figure 5:
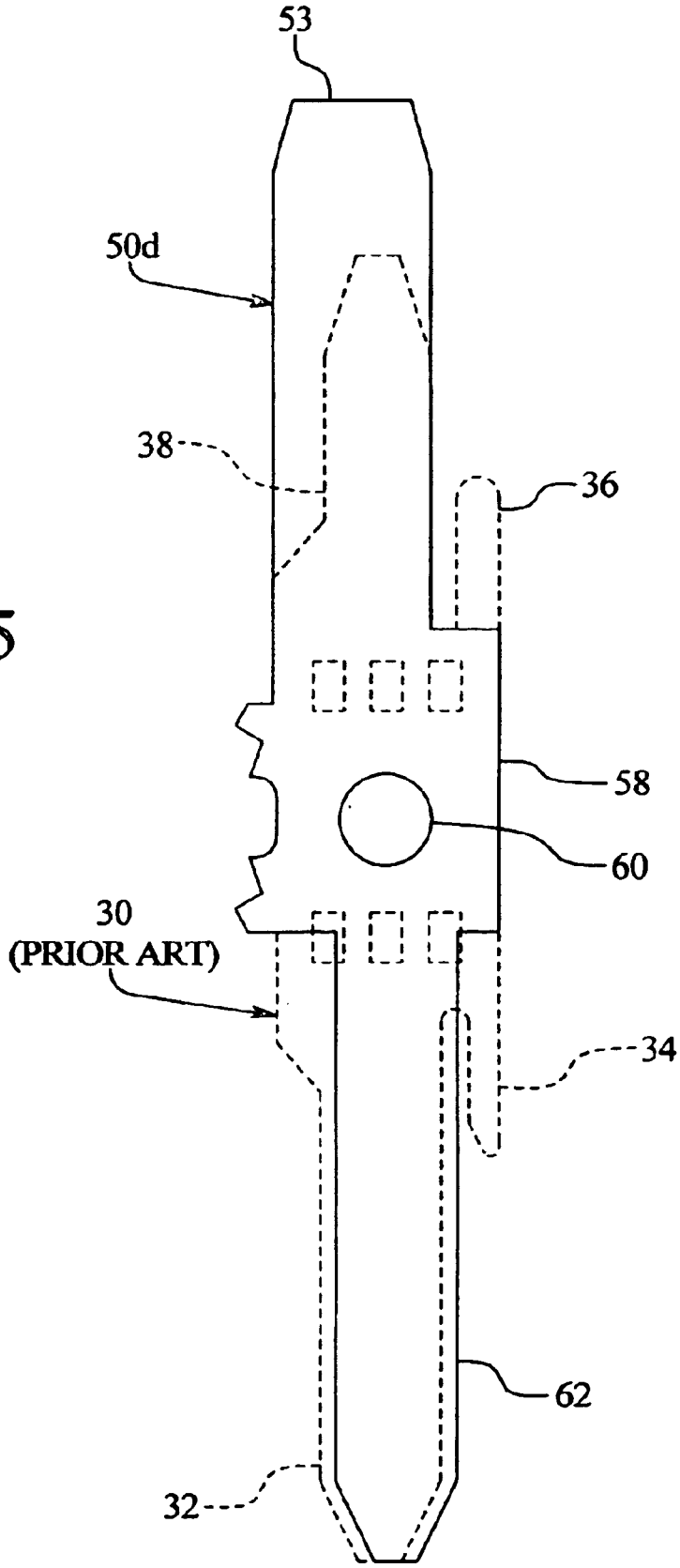

Referring now to FIG. 5, the terminal 50*d* is used with the female type replacement fuse and therefore includes the single projection 53, which receives the female terminal of the female fuse. The terminal 50*d*, however, is used with a surface mount fuse element, which removes the need for a separate groove or notch. Accordingly, terminal 50*d* does not provide or include the projection 56.

Figure 6:
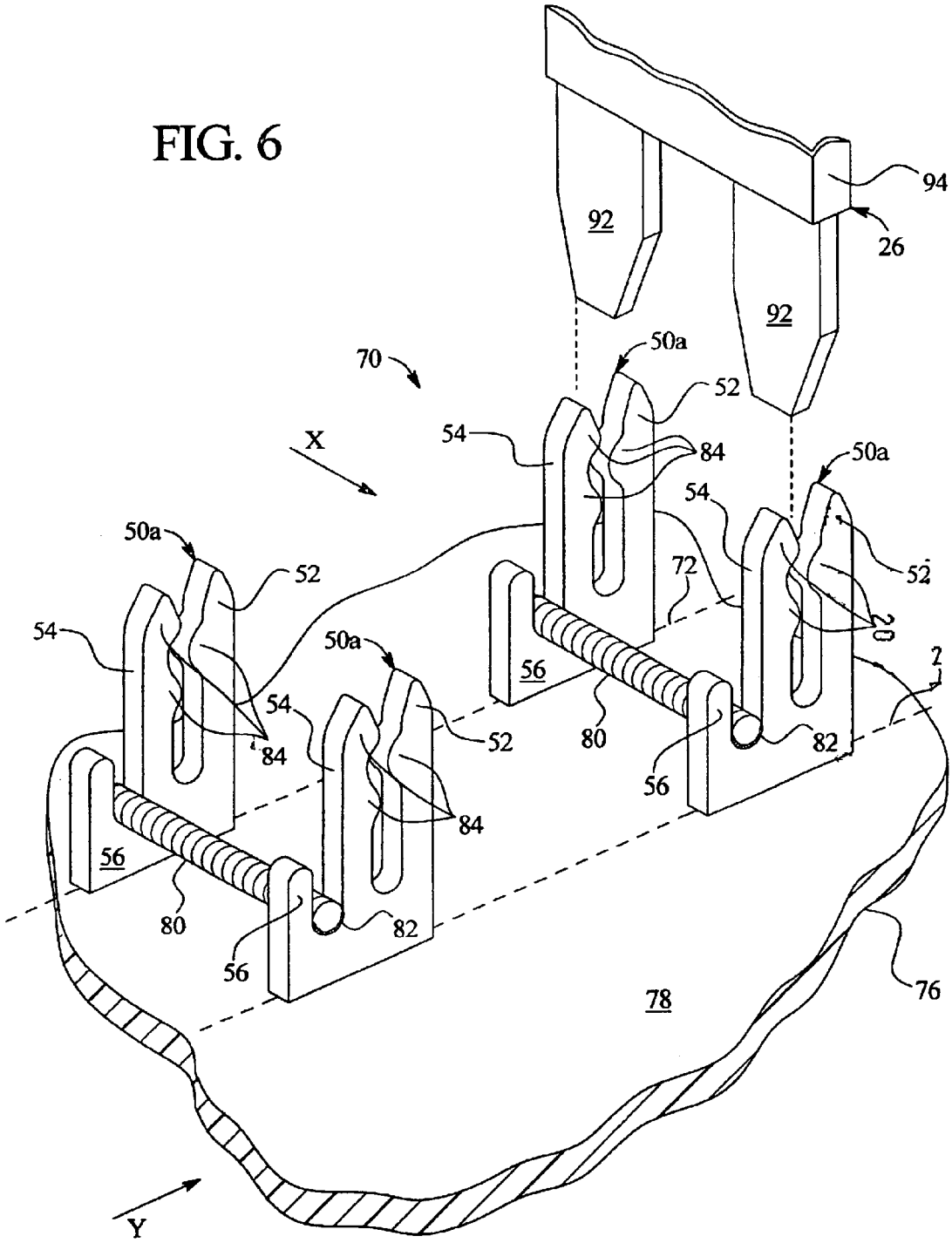
FIG. 6 is a perspective view of one embodiment of a terminal arrangement for the fuse block of the present invention.

Referring now to FIG. 6, an arrangement 70 of terminals includes a plurality of terminals of the present invention arranged in sets or rows. The arrangement 70 is illustrated with the terminals 50*a* and a male type blade fuse 26, however, any of the other terminals 50*b* to 50*d* and/or a female type blade fuse 26 could alternatively be used and illustrated. The arrangement 70 is illustrated as having two sets or rows 72 and 74. Each set or row 72 and 74 includes two terminals 50*a*. The present invention is adaptable to have any number of sets or rows of terminals 50*a*, wherein each set or row can have any number of the terminals 50*a*. The terminals 40*a* of the sets 72 and 74 are permanently fixed to a fuse block body 76, which is illustrated in FIG. 6 in a cutaway manner for convenience.

The fuse block body in one embodiment is any type of plastic suitable for an electrical and an automotive application. Plastics suitable for the fuse block body 76 include, but are not limited to, polyamide, polyethylene-terephthalate and polyphthalamide. The fuse block body 76 may have any suitable configuration and thickness and in an embodiment includes a relatively flat surface 78 from which the forked projections 52 and 54 and the third projection 56 project. The terminals 50*a* are conductive. The terminals 50*a* may be made of any metal suitable for automotive fuse terminals, such as C151, C425 and C7025 alloys.

In the arrangement 70, one of the terminals 50*a* from the row 72 makes an electrical connection with one of the terminals 50*a* from the row 74 via a fuse element 80. The fuse element 80 may be made of any material known to those of skill in the art. The fuse element 80 may be made of any shape known to those of skill in the art. In an embodiment, the fuse element 80 includes a resistance wire. In an embodiment, the fuse element 80 includes a punched element.

In one embodiment, the fuse element 80 is spiral wound. For example, the fuse element 80 can use tin plated copper wire wound about a substrate. The spiral wound fuse element 80 creates a time delay fuse element. U.S. Pat. Nos. 4,409,729, 4,560,971 and 4,736,180 involve spiral wound fuse elements, the teachings of which are incorporated herein by reference.

In the arrangement 70, each of the terminals 50*a* of the row 72 makes an electrical connection with an adjacent terminal 50*a* of the row 74, via a fuse element 80. In this manner, the terminals 50*a* of the sets 72 and 74 in combination with the fuse elements 80 embedded into the fuse block body 76, form a multi-element fuse array. Indeed, the terminal pairs 50*a* from the respective rows 72 and 74 in electrical communication with the fuse element 80 form fuses or fuse connections. Although each of the rows 72 and 74 in the arrangement 70 includes the same number of terminals, it is possible that the rows do not have the same number of terminals 50*a*.

In an embodiment, the fuse element 80 solders to, mechanically links to or otherwise maintains a fixed electrical connection with the terminals 50*a*. In the illustrated embodiment for the arrangement 70, the fuse elements 80 solder to the terminals 50*a* via a solder joint 82. Thus, it should be appreciated that the terminals 50*a* have a first portion that contacts or electrically connects to the fuse element 80. The first portion in the illustrated embodiment includes the projection 56, the projection 54 and a groove or notch defined therebetween.

Each of the terminals 50*a* also includes a second portion that a receives a terminal of a replacement fuse 26. The replacement fuse 26 in an embodiment is a standard automotive blade fuse. For example, in one embodiment, the replacement fuse 26 is a MINI® fuse manufactured by the assignee of the present invention. As is well known, automotive replacement fuses, such as the fuse 26 include a pair of terminals 92 and a plastic housing 94 enclosing a portion of same.

The second portion of the terminal 50*a* that electrically engages the terminals 92 of the replacement fuse 26 includes the forked projections 52 and 54 and a groove or notch defined therebetween. The forked projections 52 and 54 are spaced apart so as to frictionally engage the terminals 92 and thereby hold the replacement fuse 26 firmly in place. To aid such frictional, press-fit, engagement, the terminals 50*a* in an embodiment include projections 84 that extend inwardly and laterally from the forked projections 52 and 54 towards the groove defined by same. The forked terminals 52 and 54 can include one or more of these inwardly extending projections 84.

Figure 1:
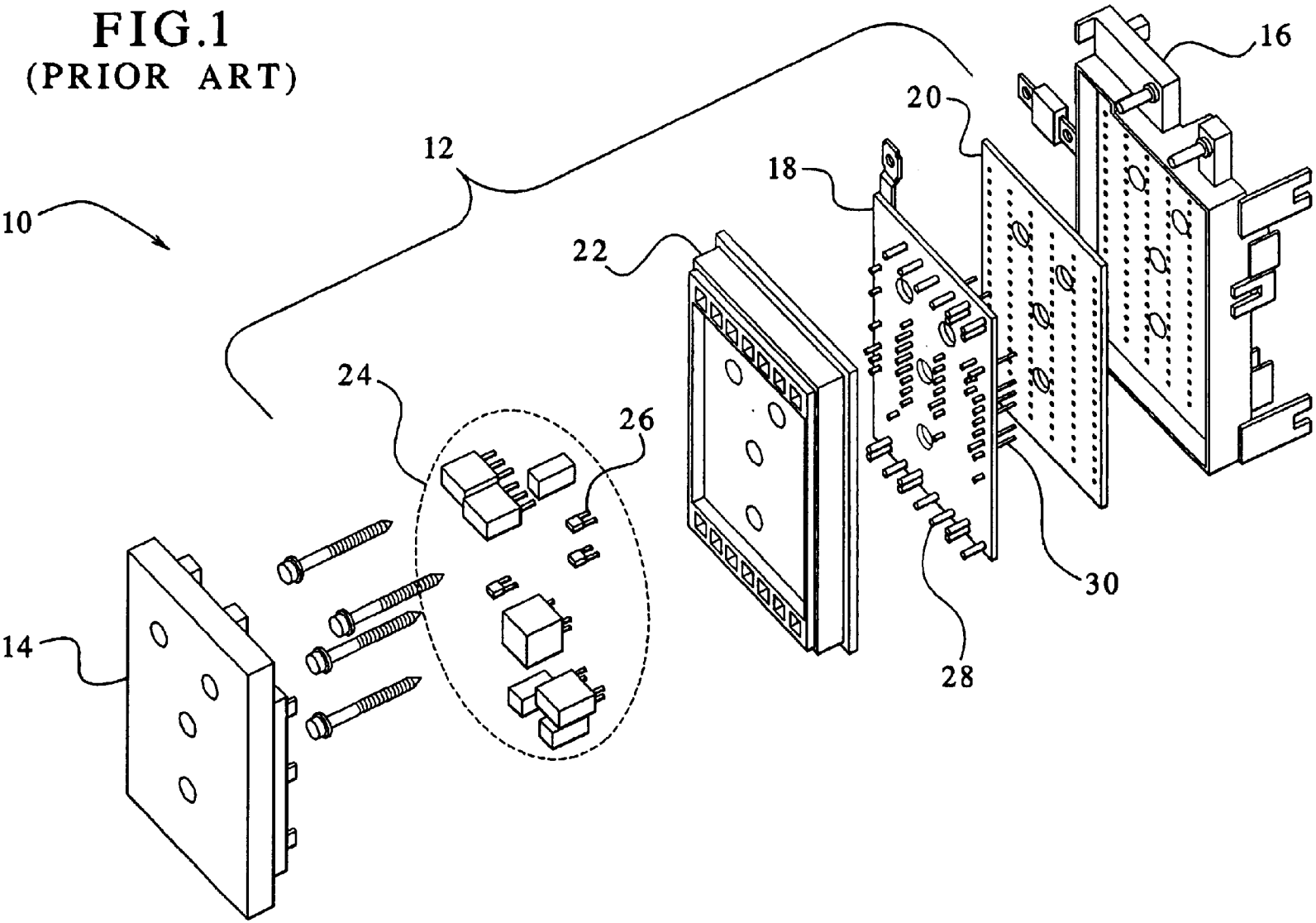
FIG.1 (PRIOR ART)
FIG. 1 is an exploded perspective view illustrating a prior art fuse block and junction box employing same.

In operation, the fuse block of the arrangement 70 initially does not require any separate or replacement fuses 26. Herein lies one advantage of the present invention over the prior art fuse blocks as illustrated in FIG. 1. When one of the fuse elements 80 opens due to an overcurrent condition, only then does an operator insert a replacement fuse 26 between the forked projections 52 and 54 of the terminals 50*a* having the open fuse condition.

It should be appreciated that the present invention is facilitated by the fact that the terminals 92 of the replacement fuse 26 have been generally standardized in terms of their spacing by the different manufacturers making such replacement fuses. The terminals 50*a* therefore can be spaced apart a predetermined distance so that the projections 52 and 54 of terminals 50*a* in adjacent rows 72 and 74 will engage both terminals 92 of any manufactured replacement fuse 26 for a given amperage rating or range of amperage ratings.

If the replacement fuse 26 opens, the replacement fuse 26 is replaced by another replacement fuse 26 as is well known in the art. However, not only does the present invention eliminate the need to initially supply separate fuses because of the fuse elements 80, the fuse block of the arrangement 70 also does not require the female inserts 28 illustrated in FIG. 1. That is, because the terminals 50*a* include the female groove or notch defined by the projections 52 and 54, there is no need to convert a male terminal into a female terminal as is done in prior art fuse blocks.

Figure 7:
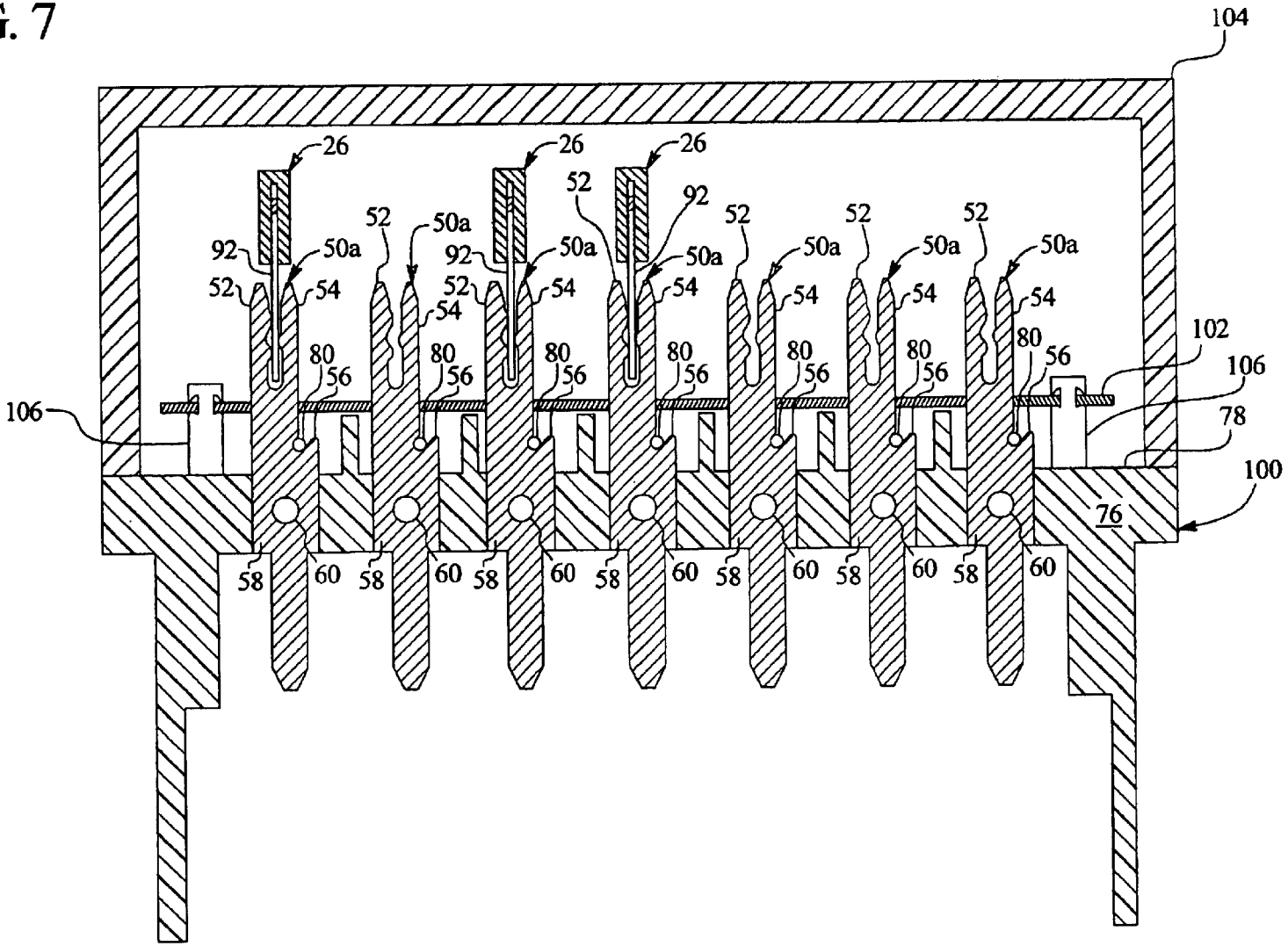
FIG. 7 is a sectioned elevation view from one of the sides of the terminal arrangement embodiment illustrated in FIG. 6.

Referring now to FIG. 7, a sectioned view of a fuse block 100 having the arrangement 70 of FIG. 6 is illustrated. More particularly, FIG. 7 illustrates a sectioned view from the direction X illustrated in FIG. 6. The illustrated fuse block 100 includes a multitude of terminals 50*a*, wherein FIG. 6 only illustrates two of these. As described above, in an embodiment each of the terminals 50*a* solders to a fuse element 80 at a portion of the terminal 50*a* defined between the projections 54 and 56. As illustrated, the fuse elements 80 are contacted or held by the terminals 50*a* at a relatively low point above the surface 78 of the fuse block body 76. Indeed, the fuse elements 80 are soldered or electrically connected to the terminals 50*a* below a protective member 102.

The protective member 102 in an embodiment is a thin plastic piece of material. The protective member 102 may be made of any suitable material, however, in a preferred embodiment the protective member 102 is clear, translucent or transparent. The protective member 102 enables an operator to view the fuse element 80 from above or outside the fuse block 100. The protective member 102 also precludes the operator from contacting or damaging the fuse elements when inserting a replacement fuse 26 into two of the terminals 50*a*.

The forked projections 52 and 54 extend past the protective member 102, so that the operator can insert the replacement fuse 26 into the terminals 50*a* without having to remove the protective member 102. The protective member 102 therefore defines a number of apertures that fit over and around the forked projections 52 and 54. As illustrated in FIG. 7, the first, third and fourth fuse elements 80 from the left have at some previous point in time opened due to some type of overcurrent event, wherein an operator has removed a cover 104 from the fuse block 100 and has inserted a replacement fuse 26 into terminals 50*a* of adjacent rows of terminals.

A number of standoffs or mounts 106 extend from the surface 78 of the fuse block 100. The protective member 102 defines apertures that fit over a portion of the mounts 106. In one embodiment, the protective member 102 is held permanently in place through a staking process. That is, the protective member 102 sits on a portion of the mounts 106, wherein another portion of the mounts 106 extends through the apertures defined by the protective member 102. The mounts 106 in an embodiment are plastic or otherwise deform due to heat. When the protective member 102 is put in place, an assembler applies heat to the portion of the mounts 106 extending through the member 102, so that the portion deforms and moves outward over the top surface of the protective member 102. When the staked portion cools and hardens, the mounts 106 hold the member 102 firmly in place. This process is commonly referred to as a "hot rivet". Obviously, in other embodiments, the protective member 102 can be bolted to, adhered to or otherwise permanently affixed to the mounts 106 through any process known to those of skill in the art.

The section of FIG. 7 cuts through the middle of the terminals 50*a* so that the apertures 60 defined by the middle portion 58 of the terminal 50*a* are illustrated. In an embodiment, the fuse block 100 is made by a plastic molding process. In the molding process, the terminals 50*a* are placed into a dye, whereupon the liquid plastic or other material making up the fuse block 100 is poured in around the terminals 50*a*. The molten plastic is also able to flow through the aperture 60. In this manner, the fuse block 100 mechanically couples through the terminals 50*a* as opposed to simply forming around and frictionally engaging the terminals 50*a*.

Figure 8:
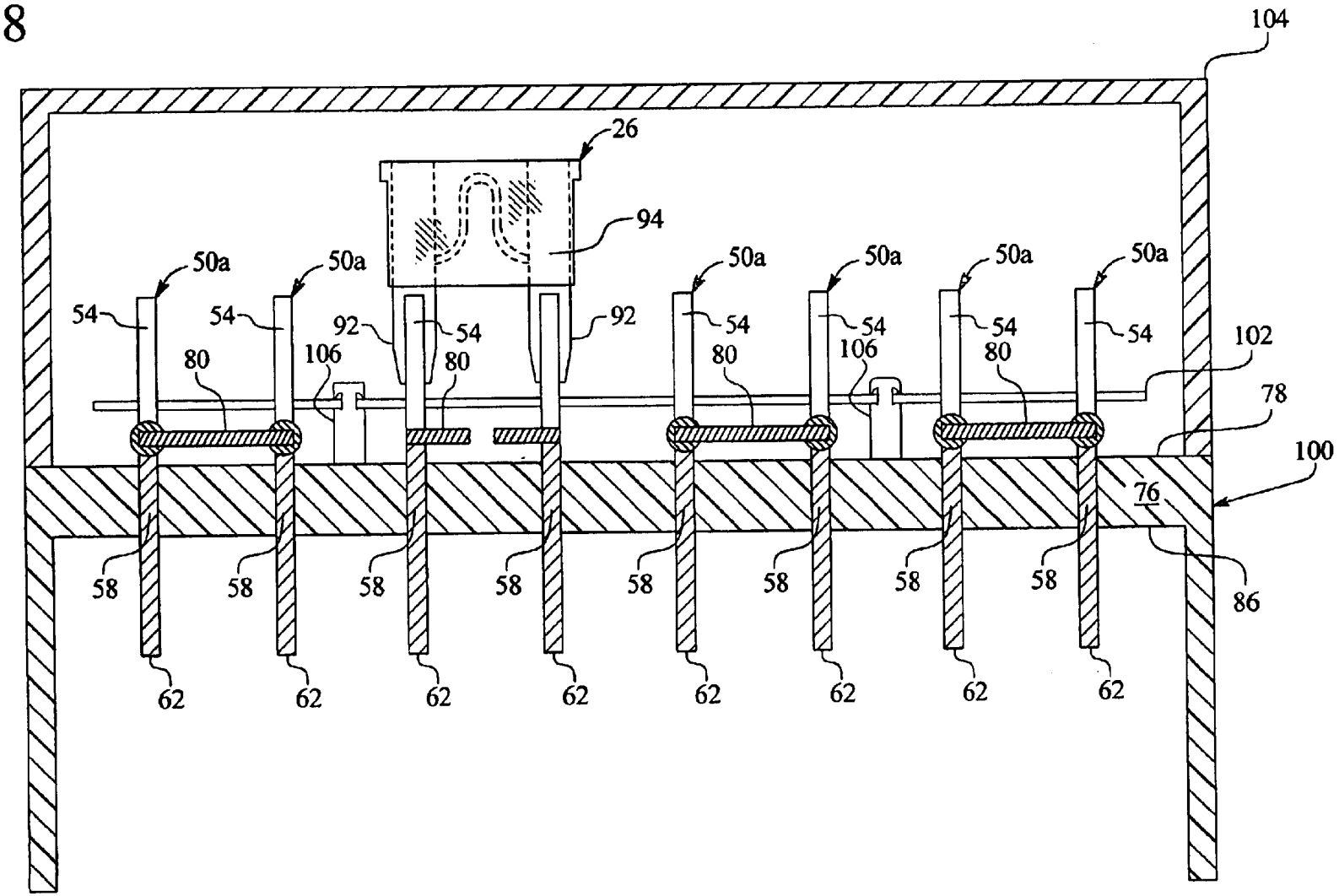
FIG. 8 is a sectioned elevation view from another of the sides of the terminal arrangement embodiment illustrated in FIG. 6.

Referring now to FIG. 8, a sectioned view of the arrangement 70 of the fuse block 100 is illustrated from the direction Y shown in FIG. 6. The section is taken through the middle of the elements 80 so that the apertures 60, which are generally located in the center of the middle portions 58, reside behind the sectioned portion illustrated in FIG. 8 and are not seen. The section taken along the terminal 50*a* in FIG. 8 also cuts through the downwardly extending projection 62 that extends beneath a lower surface 86 of the fuse block body 76 of the fuse block 100.

FIG. 8 illustrates the clear or transparent protective member 102 mounted above the fuse elements 80 via the staked surfaces of the mounts 106. FIG. 8 illustrates the Y direction spacing of the mounts 106. FIGS. 7 and 8 illustrate an arrangement having eight sets or rows such as the sets or rows 74 and 72 of terminals 50*a*. The rows in the arrangement 70 create four electrical connections. Each of the rows as indicated by FIG. 7 includes seven terminals 50*a*. Thus, the fuse body 100 of FIGS. 7 and 8 having the arrangement 70 of FIG. 6 can hold up to twenty-eight replacement fuses 26.

FIG. 8 illustrates that the second fuse element 80 from the left has opened, wherein an operator has inserted a replacement fuse 26 into the terminals 50*a* that are soldered to or electrically connected to the opened fuse element 80. The terminals 92 of the replacement fuse 26 insert behind the projection 54, which is seen in the section of FIG. 8.

As illustrated in FIG. 8, the cover 104 is sized so that the cover fits over the fuse block 100 in a manner such that the cover does not contact or obstruct the housing 94 of the replacement fuse 26 when same has been inserted to remedy an open fuse condition.

Figure 9:
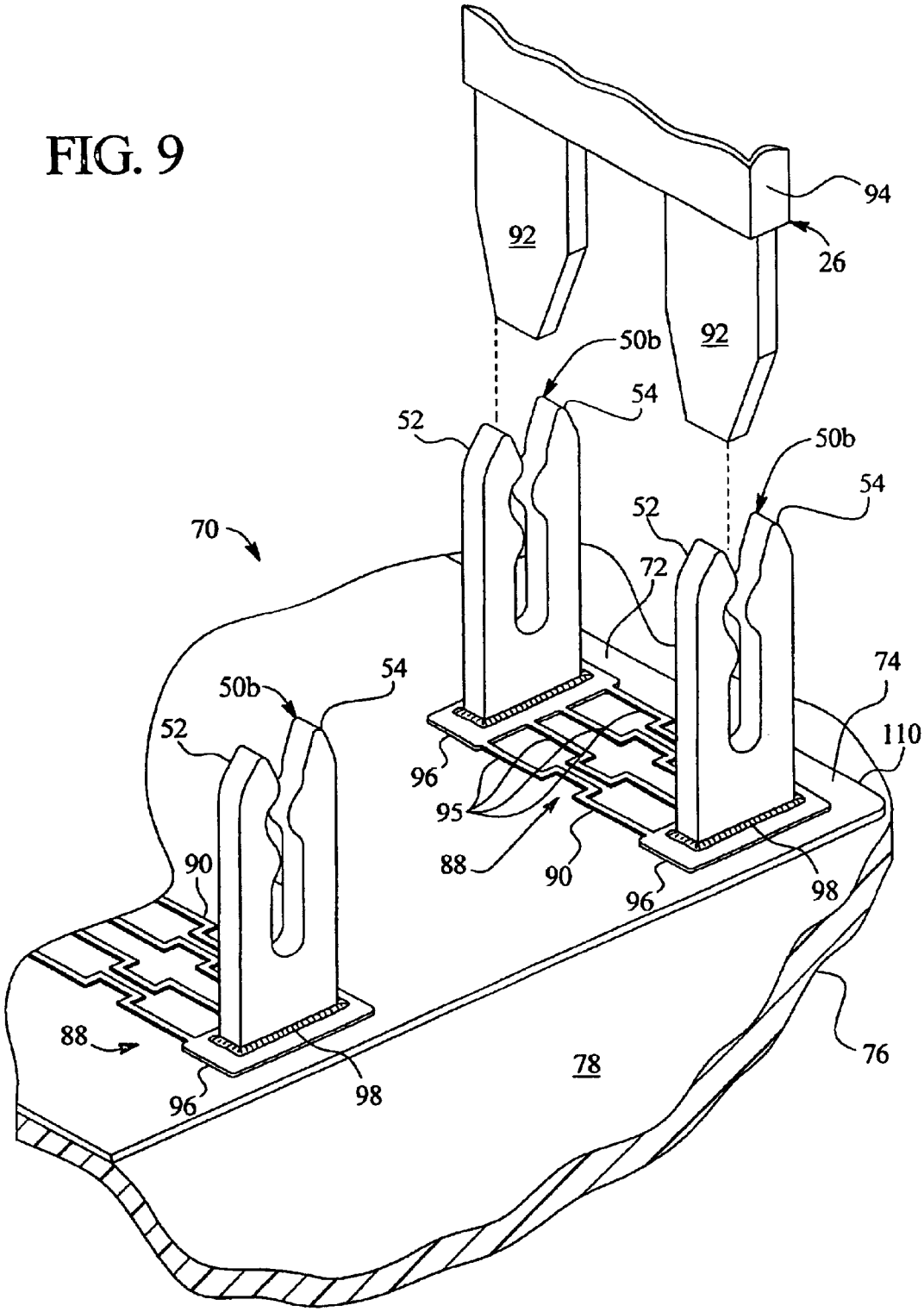
FIG. 9 is a perspective view of the terminal arrangement of FIG. 6, which illustrates one embodiment for providing a surface mount or thin film fuse element.

Referring now to FIG. 9, an embodiment of a surface mount fuse element 88 of the present invention is illustrated. The fuse block includes the same terminal arrangement 70 of as illustrated in FIGS. 6, 7 and 8. Here, a plurality of sets or rows of terminals 50*b*, such as rows 72 and 74, are provided. The projection 56 of the terminals 50*a* or 50*c* is not needed because the fuse element 88 is surface mounted. The illustrated embodiment shows the blade type replacement fuse 26. In an alternative embodiment, a female replacement fuse is used, wherein the terminals would then be the terminals 50*d*.

The surface mount fuse element 88 in an embodiment includes one or more copper traces as is well known to those of skill in the art. It should be appreciated however that the fuse element 88 can include any type of conductive material or combination thereof. The fuse element 88 includes a portion 90 that extends between two adjacent terminals 50*b* of different rows and a portion 96 that extends around the terminals 50*b*.

In an embodiment, a separate member or substrate 110 is provided for the fuse element 88. The terminals 50*b* are still molded into the fuse block body 76 as discussed above. The substrate 110, which defines apertures that fit around the arrayed terminals 50*b*, is placed over the terminals 50*b* and butted against the surface 78 of the body 76. In an embodiment, the terminals 50*b* are soldered to the portions 96 of the fuse elements 88 via solder joints 98.

The substrate 110 in an embodiment is made of an FR-4 epoxy sheet. FR-4 epoxy sheets are manufactured by Allied Signal Laminate Systems, Hoosick Falls, N.Y. with a copper plating on both sides thereof. The substrate 110 attaches to the surface 78 of the fuse block body 76 via any suitable method known to those of skill in the art. For example, the substrate 110 in an embodiment adheres to the surface 78. In another embodiment, the substrate 110 bolts to or otherwise mechanically fastens to the body 76. In another embodiment, the substrate 110 solders to the surface 78. Further alternatively, any combination of these embodiments may be employed.

In an alternative embodiment, the surface mount fuse traces can be placed directly onto the surface 78 of the body 76. However, it is likely easier to put the substrate 110 through a surface mount process, such as a photoresist process, than the generally three-dimensional and plastic fuse block body 76. Also, using the substrate 110 avoids the problem of deciding whether or not to plate the terminals 50*b*. The fuse elements 88 can be applied to the substrate 110 via any suitable method for placing copper traces onto substrates. In an embodiment, the fuse element 88 is applied to the substrate 110 via a known photoresist process.

In one embodiment of the photoresist process, the substrate 110 is initially stripped of copper and replated with a copper layer. The reapplication of copper occurs through the immersion of the substrate 110 into an electroless copper plating bath. This method of copper plating is well known in the art. The copper plating step results in the placement of a copper layer having a uniform thickness on all exposed surfaces of substrate 110. In an embodiment, the apertures that slide over the terminals 50*b* are made before the plating step so that the aperture walls are plated. The plated walls may or may not be stripped of the copper. In a further embodiment, the apertures are made at the end of the process so that the aperture walls are not plated.

After the copper application, the substrate 110 is covered with a so-called photoresist polymer. After the substrate 110 is covered with the photoresist, a clear mask is placed over portions of the substrate 110 and photoresist. The masked portions include all regions on the substrate 110 which are not to have a conductive metal layer or trace. The clear mask is made of an UV light-opaque substance. Placing the mask onto portions of the copper plated substrate 110 and photoresist effectively shields these portions from the effects of UV light. Again, these portions or regions include all areas of the substrate 110 not covered by either a fuse element 88.

The masked regions therefore define the shapes and sizes of the fuse elements 88. The width, length, shape, configuration and number of fuse elements 88 may be altered by changing the size and shape of the UV light-opaque regions. For example the illustrated fuse element 88 includes a plurality of copper strands 95, which act in parallel to connect the portion 90 to the portion 96. The strands 95 provide a time delay characteristic to the fuse element 88 much the same as does spiral winding the fuse element 80.

The plated, photoresist-covered, and partially masked substrate 110 is then subjected to UV light for a time sufficient to ensure curing of all of the photoresist that is not covered by the masked regions. Thereafter, the masks are removed from the substrate 110. The photoresist that has been below the masks remains uncured and is washed from portions of the substrate 110.

The cured photoresist on the remainder of the plated substrate 110 sheet provides protection against the next step in the process. Particularly, the cured photoresist on the plated substrate 110 prevents the removal of copper beneath those areas of cured photoresist. The regions formerly below the masks have no cured photoresist and no such protection. An etching process is then used to remove the copper from portions of the substrate 110. Etching includes a ferric chloride solution applied through well known etching concepts.

After the copper has been removed from the areas formerly below the masked regions, all that remains in these areas is the FR-4 or other material of the substrate 110. The substrate 110 is finally placed in a chemical bath to remove the cured photoresist to reveal the copper tracings of the fuse element 88 of the present invention.

The completed substrate is then placed over the terminals 50*b*, wherein the portions 96 are soldered to same via solder joints 98. U.S. Pat. Nos. 5,552,757, 5,790,008 and 5,884,477 involve surface mount or thin film fuse elements, the teachings of which are incorporated herein by reference.

Figure 10:
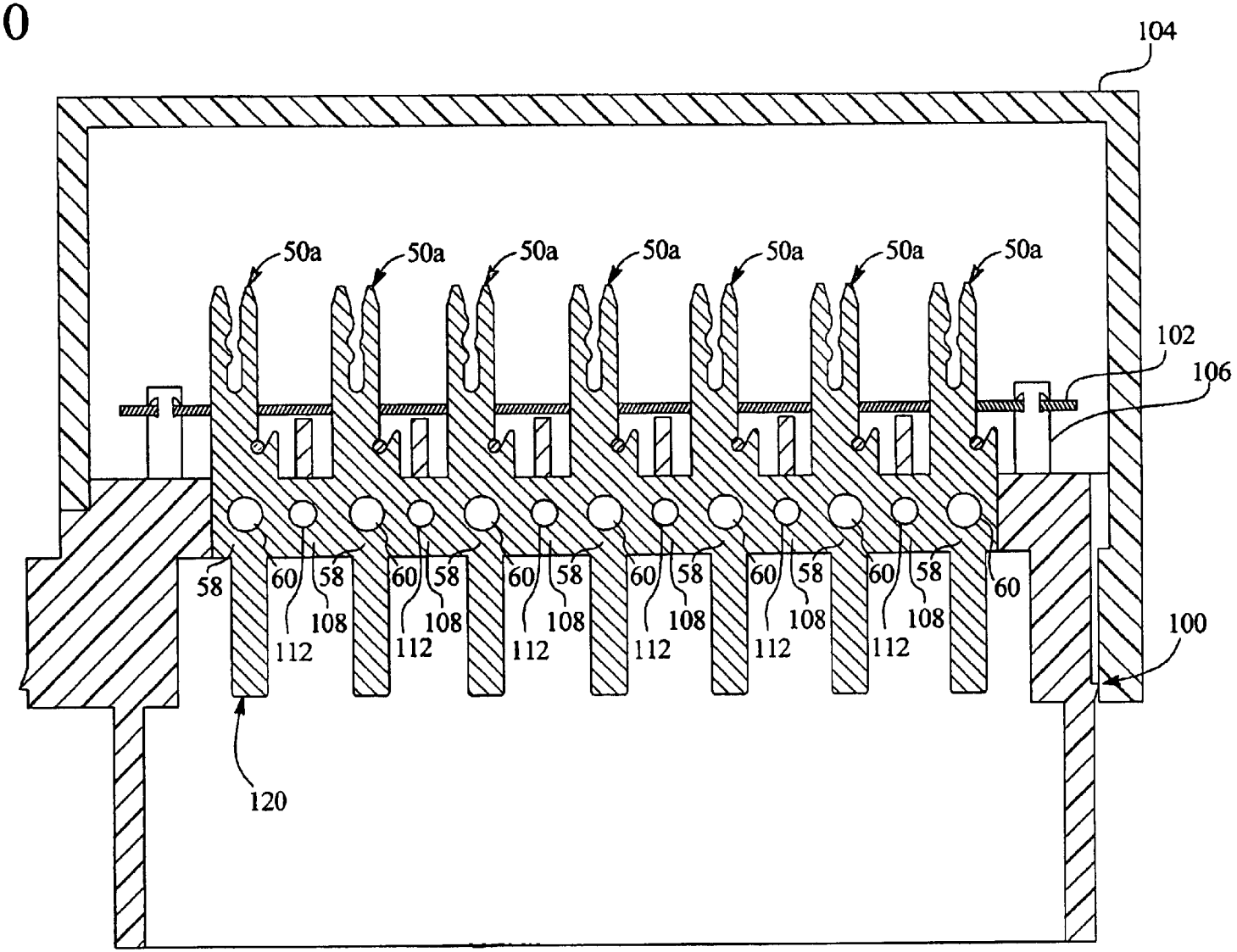
FIG. 10 is the same sectioned view as illustrated in FIG. 7, which illustrates one embodiment for providing the wire bussing of the present invention.

Referring now to FIG. 10 one embodiment for electrically connecting a multitude of terminals of the same row is illustrated. FIG. 10 is illustrated using the terminals 50*a* for a male type blade fuse 26, however, any of the other terminals 50*b* to 50*d* and/or a female type replacement fuse could alternatively be used and illustrated.

FIG. 10 includes the same components illustrated in FIG. 7. The fuse block 100 includes a body 76. A cover 104 sits atop the fuse block 100. A number of standoffs or mounts 106 extend from the fuse block 100 and attach the protective member 102. The fuse block 100 mechanically couples the terminals 50*a* via the apertures 60 defined by the middle portions 58 of the terminals 50*a*.

The terminals 50*a* are provided in a single strip 120 of terminals, wherein bridging portions 108 couple the middle portions 58 of adjacent terminals 50*a*. It is common to provide a strip of terminals and separate or break off individual terminals. Here, the terminals 50*a* are left in the form of a strip 120, where the entire strip 120 is molded into the body 76 of the fuse block 100. In an embodiment, the bridging portions 108 include one or more apertures 112 to enable liquid plastic to flow through same, which helps to secure the strip 120 of terminals 50*a* in the body 76 of the fuse block 100.

The strip 120 enables the terminals 50*a* to electrically communicate, which is commonly termed "bussing". In the prior art FIG. 1, the bussing is provided on one or both surfaces of the upper press-fit layer 18 and the lower press-fit layer 20. The bussing typically includes a complicated series of channels, wherein copper wire runs throughout the channels and connects to certain terminals at certain points. FIG. 10 illustrates that the bussing can more easily take place by being provided within the fuse block body 76.

The terminals are typically bussed to provide power to one side of the fuse connections. Typically, the bussing provides a common power line that runs to one side of the electrical connection, wherein the terminal on the other side of the fuse elements electrically connects to a wire that runs to a load device. The strip 120 of terminals 50*a* therefore in an embodiment electrically connects to a common power line, wherein the strip 120 brings power to each of the terminals that have a fuse connection to the strip 120.

The bridging portions 108 of the strip 120 are sized so that the terminals 50*a* are spaced apart in the set or row a desired distance. The strip 120 can be broken in one or more places so that the only selected terminals 50*a* or selected groups of terminals 50*a* in a set or row are electrically connected.

In an embodiment, a plurality of pairs of rows of fuse-linked terminals each include one row that has strip 120 of terminals electrically connected to a common power supply line. For instance, in FIGS. 6 and 9, one of the illustrated rows 72 or 74 includes the strip 120 of terminals. FIG. 8 illustrates another example. In each of the pairs of terminals 50*a* linked by a fuse element 80, one of the terminals 50*a* belongs to a strip 120 of terminals. In each of these examples, power conducts along the strip 120 to the fuse elements (separate fuse element 80 or surface mount fuse element 88) and to the terminals of the fuse-linked row, wherein these terminals electrically connect with wires that run to various load devices, for example, within an automobile. Once one of the fuse elements 80 or 88 opens, a replacement fuse 26 (or a female replacement fuse) remakes a fuse-linked power connection.

In alternative embodiments, the bussing could be provided by separate wires or through surface mount traces. If by separate wires, the wires in an embodiment could solder to the terminals. If by surface mount traces, the bussing could be added to the substrate having the surface mount fuse elements.

Figure 11:
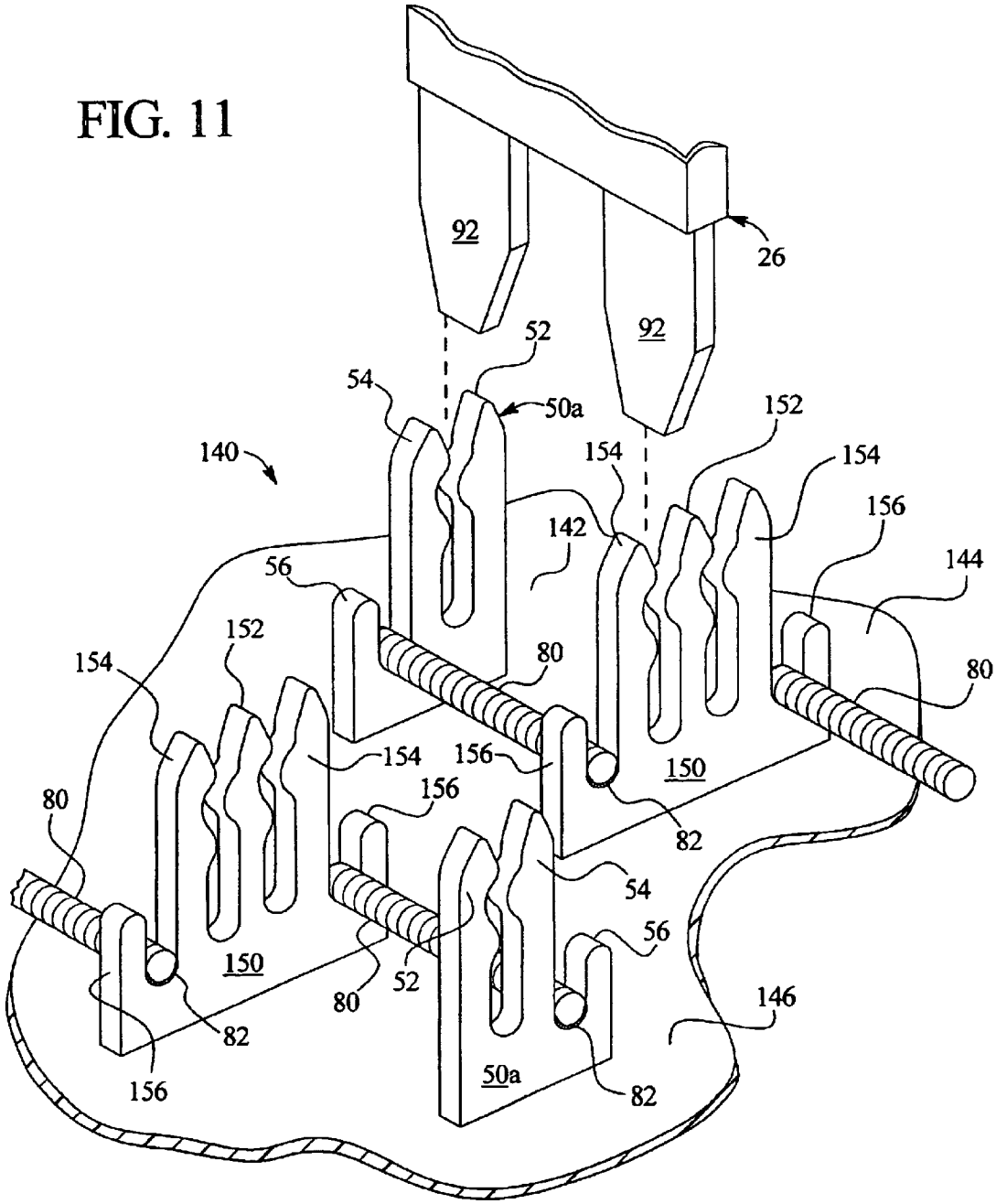
FIG. 11 is a perspective view of another embodiment of a terminal arrangement for the fuse block of the present invention.

Referring now to FIG. 11, an alternative arrangement 140 for the terminals of the present invention is illustrated. The alternative arrangement 140 differs from the arrangement 70 in that three rows 142, 144 and 146 of terminals work in cooperation with one another as opposed to the dual row of the arrangement 70. Three adjacent terminals of the rows 142, 144 and 146 work together to form two electrical connections, wherein the arrangement 70 requires four adjacent rows to form two electrical connections. Thus, the arrangement 140 decreases the amount of space needed for the same number of fuse connections by about twenty-five percent.

The arrangement 140 provides two different types of terminals, namely the terminals 50*a*, which are placed in the outer rows. It should be appreciated that the arrangement 140 can alternatively operate with a substrate, similar to the substrate 110 having the surface mounted fuse elements 88, wherein terminals 50*b* are placed in the outer rows. Further, the arrangement 140 can alternatively operate with a female replacement fuse, wherein terminals 50*c* or 50*d* are placed in the outer rows.

The arrangement 140 also includes double terminals 150, which are placed in the middle row 144. The double terminals 150 include mirrored projections 154 and 156 that provide first and second portions for holding two separate elements 80, for example, via solder joints 82. The double terminals 150 include a single center projection 152 that cooperates with the mirrored projections 154 to provide two slots for two replacement fuses 26. Therefore, the alternative arrangement 140 allows for adjacent terminals of adjacent rows of open fuse elements to be replaced with a replacement fuse 26.

In an alternative embodiment, the arrangement 140 provides two male projections, such as two male projections 53 illustrated in FIGS. 4 and 5, wherein the arrangement 140 would allow for adjacent terminals of adjacent rows of open fuse elements to be replaced with a female replacement fuse, such as a JCASE® fuse.

In the alternative arrangement 140, the outer rows 142 and 146 of the threesome of rows are staggered to receive the fuse elements 80 from the mirrored grooves defined by the projections 154 and 156. Also, the terminals 50*a* of the rows 142 and 146 are oriented in opposite directions so as to align the notch or groove defined by the projections 52 and 54 with the notch or groove defined by the projections 152 and 154 of the double terminal 150.

The arrangement 140 includes each of the advantages and embodiments described above in connection with the arrangement 70. For example, the middle row 144 of terminals 150 can be electrically linked or bussed, for example, by being made and installed in a strip. The strip of terminals 150 enables a common line to bring power to two different rows of electrically connected terminals, which lead to various loads, for example, within an automobile.

In an alternative embodiment (not illustrated) a single longer separately mounted fuse element could be woven through and soldered at multiple points to the double terminal 150 and then electrically connected to the two outer adjacent terminals 50*a* via a solder joint 82 as described above. The longer fuse element in an embodiment has the same diameter as the fuse element 80 and is made from any of the materials discussed above for the fuse element 80. The longer fuse element can also be spiral wound to exhibit time delay characteristics.

Figure 12:
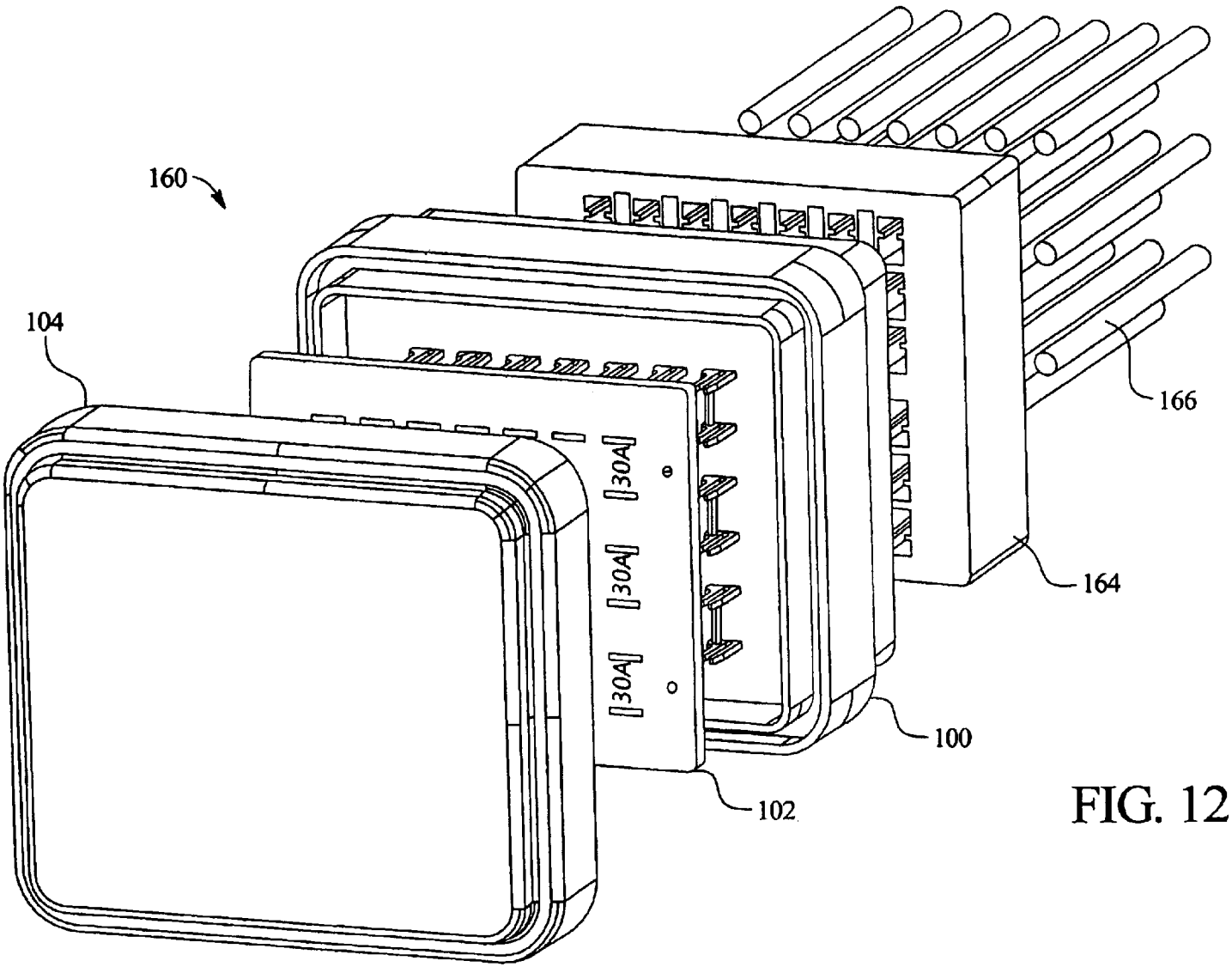
FIG. 12 is an exploded perspective view of one embodiment of a junction box employing the fuse block of the present invention.
Figure 13:
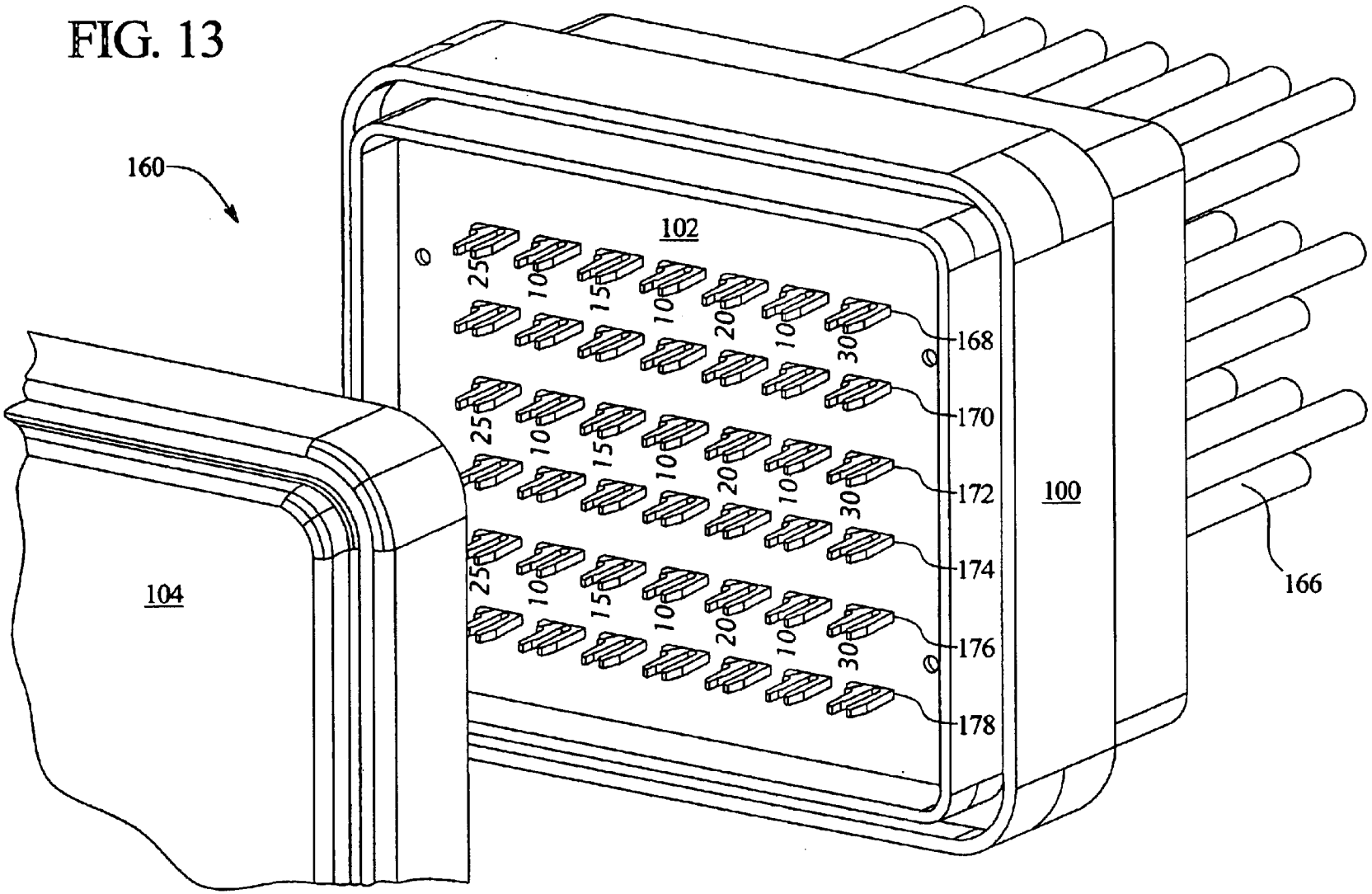
FIG. 13 is an assembled perspective view of the junction box of FIG. 12.

Referring now to FIGS. 12 and 13, a junction box 160 employing the terminal arrangements of the present invention is illustrated. The junction box 160 includes a cover 104, the protective member 102, the fuse block 100 and a plug-in wire module 164. The plug-in wire module 164 connects to a plurality of wires 166, which are connected to various loads, for example, loads within automobile. The wires 166 also include one or more power wires.

Each of the components of the junction box 160 may be made of various desired materials, such as plastic. The fuse block 100 may be cast as a single piece or be assembled from multiple pieces. In a preferred embodiment, the terminals are molded into one of the pieces as described above. The fuse block 100 is illustrated employing the arrangement 70, which includes two rows of terminals cooperating to produce one fuse connection for each pair of terminals. It should be appreciated however that the fuse block 100 could alternatively employ any of the terminal arrangements disclosed above.

The plug-in module 164 enables the wires 166 to make quick electrical connections with the downwardly extending projections 62 of the terminals 50 (FIGS. 2 to 5). The module 164 in an embodiment snap-fits or bolts to the fuse block 152. The module 164 in one preferred embodiment is removable so that an operator may easily connect and disconnect the wires 166 from the module 164.

FIG. 13 illustrates the assembled junction box 160, wherein the module is hidden behind the fuse block 100 and the cover 104 is removable. FIG. 13 also illustrates that the rows 168, 170, 172, 174, 176 and 178 of terminals include fuse elements having different ratings. These ratings, as illustrated, are clearly marked on the protective member 102. In an alternative embodiment, pairs of rows could alternatively have different fuse ratings. For example, each of the fuse elements between the rows 168 and 170 could be rated for thirty amps, while the fuse elements between the rows 172 and 174 are rated for twenty amps, and while the fuse elements between the rows 176 and 178 are rated for ten amps.

The terminals electrically connect to the separate fuse elements 80 having varying diameters or to the traces of the surface mount fuse elements 88 having varying width or height. Obviously, the fuse ratings of the junction box 160 can be arranged in any order and be provided in any quantity to suit an automobile manufacturer or other user of the fuse block 100 of the junction box 160 of the present invention. It is also possible to mix and match the various embodiments for the terminals 50*a* to 50*d*, and use both male and female replacement fuses.

The junction box 160 is simple and lightweight enough to be simultaneously placed in a multitude of different positions within an automobile. Multiple junction boxes 160 having the same or different combinations of fuse ratings could therefore be placed near the loads to which they supply power. A single common power supply line feeds each module 164. The multitude of wires that run to the loads are shorter because they do not have to run from one master junction box as is now the case in the majority of automobiles. The present invention therefore cuts down on the length and weight of wire that is needed inside of a vehicle. This reduces cost and potential for shorts while increasing dependability and fuel efficiency.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

What is claimed is:

1. A fuse block comprising:

a body;

a plurality of terminals fixed to and exposed on at least one side of the body, the terminals each including a replacement fuse connection portion;

a fuse element visible without having to remove one of the replacement fuses if the replacement fuse is connected to the connection portions of two of the terminals fixed to the body, the fuse element contacting the terminals at a location separate from each of the replacement fuse connection portions;

at least three pairs of the terminals arranged in the body; and a single terminal bus in electrical communication with one of the terminals of each of the pairs.

2. The fuse block of claim 1, wherein the body includes a plastic piece.

3. The fuse block of claim 1, wherein the fuse element includes a resistance wire, a punched element or spiral winding.

4. The fuse block of claim 1, wherein the fuse element is surface mounted.

5. The fuse block of claim 4, wherein the surface mounted fuse element includes multiple strands.

6. The fuse block of claim 4, wherein the surface mounted fuse element includes means for electrically connecting the fuse element to the terminals.

7. The fuse block of claim 1, wherein the terminal pairs are arranged in a row.

8. The fuse block of claim 1, which includes a plurality of fuse elements that each connect the terminals of one of the pairs.

9. The fuse block of claim 8, wherein at least two of the plurality of fuse elements have different ratings.

10. The fuse block of claim 1, wherein the terminals of the terminal bus are formed integrally with one another.

11. The fuse block of claim 1, wherein the terminals of the terminal bus are formed on a strip.

12. The fuse block of claim 1, wherein the terminals supplied by the bus are electrically connected to a power supply line.

13. A fuse block comprising:

a plurality of rows of pairs of terminals, the terminals each including a replacement fuse connection portion, the terminals of at least two pairs of each row being electrically connected by a fuse element, each fuse element visible to a person viewing the rows of terminals without having to remove a replacement fuse located adjacent to the fuse element.

14. The fuse block of claim 13, wherein at least two terminals from at least one of the rows are commonly bussed.

15. The fuse block of claim 13, wherein a common bus supplies one of the terminals of each of the pairs of at least one of the rows.

16. The fuse block of claim 15, wherein the common bus includes an integrally formed strip of terminals.

17. The fuse block of claim 13, wherein at least two adjacent pairs of terminals within the same row of terminal pairs have different fuse amperage ratings.

18. The fuse block of claim 13, wherein at least two adjacent pairs of terminals in different rows of terminal pairs have different fuse amperage ratings.

19. A fuse block comprising:

a body; and first, second and third sets of terminals positioned in the body, wherein one of the terminals from the second set is electrically connected to one of the terminals of the first and third sets by at least two fuse elements, the terminal from the second set configured and arranged to connect to a portion of each of at least two replacement fuses.

20. The fuse block of claim 19, wherein the first, second and third sets of terminals are arranged in separate rows.

21. The fuse block of claim 20, wherein the first and third rows are outer rows and are staggered.

22. The fuse block of claim 19, which includes a plurality of fuse elements that individually contact at least two terminals from the first, second and third sets of terminals.

23. The fuse block of claim 19, wherein at least two terminals from one of the first, second and third sets of terminals are electrically connected.

24. The fuse block of claim 19, wherein at least two terminals from one of the first, second and third sets of terminals are provided on a strip.

25. The fuse block of claim 19, wherein each of the terminals in one of the sets of terminals is electrically connected to a power supply line.

26. The fuse block of claim 19, wherein the second set of terminals is positioned between the other two sets, and wherein the terminals of the second set are electrically connected to a power supply line.

* * * * *